US006390706B1

(12) United States Patent
Yokouchi et al.

(10) Patent No.: US 6,390,706 B1
(45) Date of Patent: May 21, 2002

(54) RETRACTABLE WRITING IMPLEMENT

(75) Inventors: Nobuo Yokouchi; Shinya Suzuki, both of Tokyo (JP)

(73) Assignee: Pentel Kabushiki Kaisha (JP)

( * ) Notice: Subject to any disclaimer, the term of this patent is extended or adjusted under 35 U.S.C. 154(b) by 0 days.

(21) Appl. No.: 09/646,328

(22) PCT Filed: Jan. 24, 2000

(86) PCT No.: PCT/JP00/00317

§ 371 Date: Sep. 15, 2000

§ 102(e) Date: Sep. 15, 2000

(87) PCT Pub. No.: WO00/44574

PCT Pub. Date: Aug. 3, 2000

(30) Foreign Application Priority Data

| | | |
|---|---|---|
| Jan. 28, 1999 | (JP) | 11-19871 |
| Jul. 30, 1999 | (JP) | 11-216132 |
| Oct. 29, 1999 | (JP) | 11-309917 |
| Dec. 28, 1999 | (JP) | 11-373438 |

(51) Int. Cl.[7] ..... B43K 5/16
(52) U.S. Cl. ..... 401/104; 401/99
(58) Field of Search ..... 401/104, 105, 401/106, 99

(56) References Cited

U.S. PATENT DOCUMENTS

| | | | | |
|---|---|---|---|---|
| 3,637,316 A | * | 1/1972 | Bross | 401/104 |
| 6,227,734 B1 | * | 5/2001 | Kageyama et al. | 401/104 |

FOREIGN PATENT DOCUMENTS

| | | |
|---|---|---|
| JP | 55028529 | 7/1980 |
| JP | 4032310 | 8/1992 |
| JP | 9058182 | 3/1997 |
| JP | 10119481 | 5/1998 |
| JP | 10264581 | 10/1998 |

* cited by examiner

*Primary Examiner*—David J. Walczak
(74) *Attorney, Agent, or Firm*—Adams & Wilks

(57) ABSTRACT

A retractable-type writing instrument has a tubular body having a longitudinal axis, a front end, a rear end, and a tip disposed at the front end. A writing medium is disposed in the tubular body for undergoing movement in an axial direction along the longitudinal axis. A clip has a first end portion is connected to the tubular body and a second end portion. An engagement member has a first surface connected to the second end portion of the clip, a second surface confronting the tubular body, and a pair of third surfaces extending from opposite sides of the second surface toward the first surface. Each of the third surfaces is inclined at a given angle relative to the longitudinal axis of the tubular body. An operating member is mounted in the tubular body for undergoing movement in the axial direction to move the writing medium between a withdrawal position at which the writing medium is withdrawn into the tubular body and a projected position at which a tip of the writing medium projects from the tip of the tubular body. An engagement body is connected to the operating member for movement therewith and for engaging the engagement member during movement of the operating member in the axial direction to lock the writing medium in the projected position.

23 Claims, 9 Drawing Sheets

①

②

③

RETRACTABLE WRITING IMPLEMENT

BACKGROUND OF THE INVENTION

1. Field of the Invention

2. Technical Field

This invention relates to a retractable type writing instrument wherein an operating member movable relative to an exterior body through operation is interlocked with a refill body having a nib at its tip, an engagement portion for engaging an engagement protrusion formed on an inner surface of a clip attached to the exterior body is formed on the operating member, the engagement protrusion is engaged with the engagement portion, thereby locking the nib of the refill body in a state of the nib projected from a tip of the exterior body, and the locking of the nib in its projected position is released by an operation to be made in the same direction as the operation for locking the nib in its projected position.

BACKGROUND INFORMATION

As one example, there is Japanese Patent Unexamined Publication (Kokai) No. H09–99691. A retractable type writing instrument disclosed in this publication is constructed such that a unidirectionally rotating cam mechanism consisting of a plurality of members is disposed in a barrel and projection and retraction of a refill received in the barrel is locked/released by repeating a pressing operation with respect to a knock part.

In a conventional retractable type writing instrument having a sliding member as in a knock type ballpoint pen, a material having a high wear resisting property, a low friction coefficient and a good slidability is used as the material of the sliding member. Moreover, a biasing force of a coiled spring for biasing a refill as an ink reservoir member backward is set to a low load value so that the projecting and retracting operation of the nib can be performed with a least possible force.

In the conventional techniques as mentioned above, however, the following problems are involved. Although they have such a mechanism in which a locking/releasing operation for a projection/retraction of a writing body is performed by a pressing operation of a pressing body, a mechanism for locking/releasing the projection and retraction is complicated, the number of component parts is increased, an assembling operation is cumbersome and the cost is increased. In addition, since the conventional techniques are constituted by incorporating the mechanism in a rear part of an interior of the barrel, there is encountered with such a problem that the length of the barrel must be increased.

As for operability of the retractable type writing instrument, the matter is not so simple as that reduction of a friction coefficient of the operating member will naturally provide enhancement of operability of the writing instrument. Instead, sureness and reliability of the locking of the projection/retraction through operation and actual feel of the operation are required. For example, in the case where the friction coefficient is too low, the operating member tends to move overly and slide, which may possibly result in an unlocked state. In contrast, if the operation is made with such a slight force as giving the operator (i.e., user) a feel of almost no load, the operator can hardly receive an actual feel that he/she has projected/retracted the nib and therefore, he/she must take the trouble to visually ascertain the locking state of the nib each time.

Furthermore, in the writing instrument wherein the biasing force of the coiled spring for biasing the refill backward is set to a low load value as mentioned above, when, for example, the writing instrument should be directly put into a pocket after use, the knock member would be most likely accidentally pressed, thus allowing the nib to be projected. This would, in many cases, result in a disaster that the operator's clothes get stained.

SUMMARY OF THE INVENTION

It is an object of the present invention to provide, in view of the shortcomings and problems inherent in the above-mentioned conventional techniques, an improved retractable type writing instrument.

A first subject matter of the present invention resides in a retractable type writing instrument wherein an operating member movable relative to an exterior body through operation is interlocked with a refill body having a nib at its tip, an engagement portion for engaging an engagement protrusion formed on an inner surface of a clip attached to the exterior body is formed on the operating member, the engagement protrusion is engaged with the engagement portion, thereby locking the nib of the refill body in a state of the nib projected from a tip of the exterior body, and the locking of the nib in its projected position is released by an operation to be made in the same direction as the operation for locking the nib in its projected position, the retractable writing instrument being characterized in that when the engagement protrusion and the engagement portion are to be engaged with or disengaged from each other by the operation, a relative movement between the engagement protrusion and the engagement portion at the time of engagement or disengagement consists of a combination of a movement in a same plane direction and a movement towards or away from the plane.

A second subject matter of the present invention resides in a retractable type writing instrument wherein a clip including an attachment basal portion with respect to an exterior body having a nib projection hole at a tip thereof, a deformation plate portion as an intermediate part and an engagement protrusion at an inner surface of the deformation plate portion is arranged outside the exterior body, a refill body having a nib at a tip thereof and storing therein ink is received in the exterior body such that the refill body can move back and forth in a state in which the refill body is biased backward by a coiled spring, an operating member is moved to cause the refill body or a connecting member with respect to the refill body to move so that the nib projects from the nib projection hole, the refill body or the member to be connected to the refill body is brought into engagement with the engagement protrusion of the clip, thereby maintaining the projected state of the nib from the exterior body, the operating member is moved again to release the engagement so that the nib is received in the exterior body by a backward biasing force of the coiled spring, the retractable type writing instrument being characterized in that the engagement protrusion of the clip is formed of polycarbonate resin, an engagement portion of the refill body or the member to be connected to the refill body with respect to the engagement protrusion is formed of polyoxymethylene resin, and a surface of the engagement portion and a protruded portion of the engagement protrusion are contacted with each other at the time of an overriding engagement for projecting the nib.

In the present invention, the mechanism for locking/releasing the projection/retraction is simple, the number of component parts is reduced, the assembling operation is easy and the cost is low. In addition, it has such an advantage that since the mechanism for locking/releasing the projection/retraction is not incorporated in a rear part of a barrel, the barrel must be reduced in length to that extent. Moreover, sureness of the locking of the projection/retraction through operation and actual feel of the operation can be obtained. Furthermore, there is no such a fear that the knock member is accidentally pressed after the writing instrument is used and the user's clothes get stained.

DETAILED DESCRIPTION OF THE PREFERRED EMBODIMENTS

A first example shown in FIGS. 1 to 5 will be described.

Figure 1:
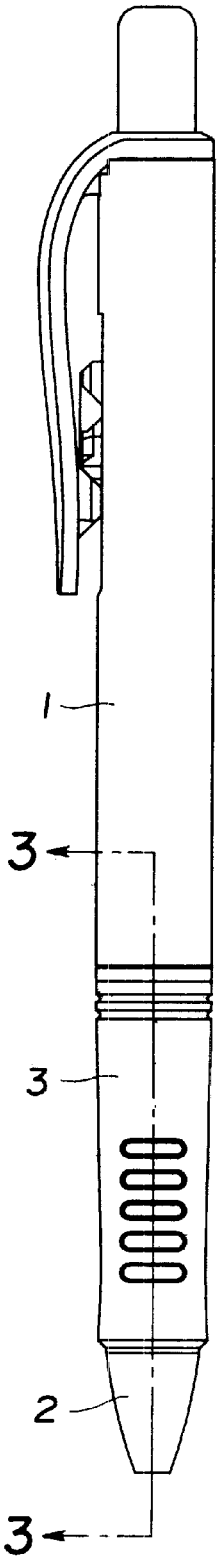
FIG. 1 is an outer appearance view showing a retractable type writing instrument of the present invention.
Figure 2:
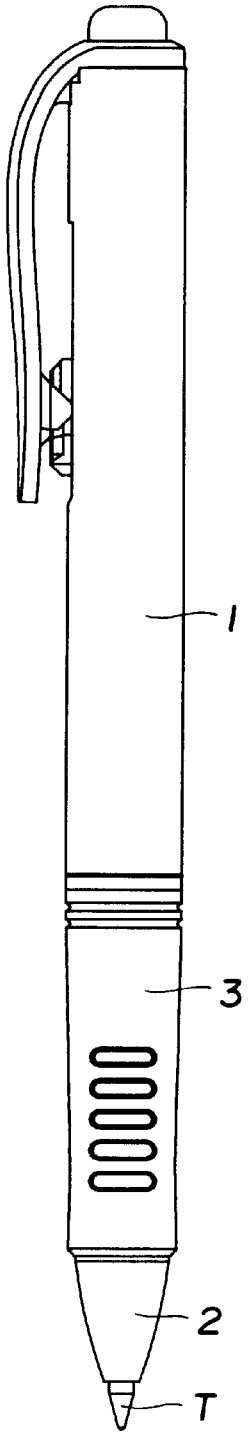
FIG. 2 is an outer appearance view, like FIG. 1, showing the retractable type writing instrument in a state that a nib projects from a front barrel.
Figure 3:
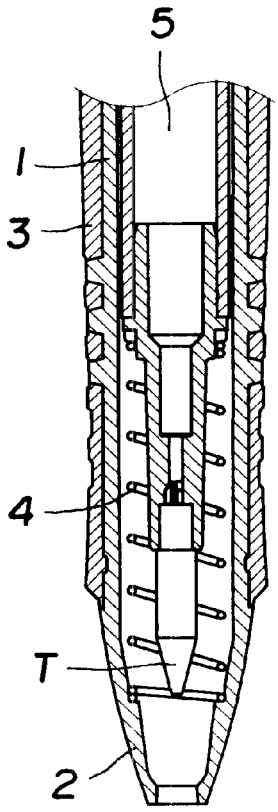
FIG. 3 is a cross-sectional view, partly broken, taken along line 3—3 of FIG. 1.

In FIG. 1 (outer appearance view), FIG. 2 (outer appearance view showing a state in which a nib projects from a front barrel) and FIG. 3 (sectional view taken on line 3—3 of FIG. 1), a front barrel (or a ferrule) 2 is detachably attached to a forward part of a tubular exterior body 1, preferably made of polymethyl methacrylic resin, by a hinge or the like (hereinafter, the upside of the illustration is referred to a "backward" and the downside as "forward", respectively). A clamping member 3 made of soft resin or rubber is secured to the front barrel 2. A resilient member 4 such as a coiled spring is attached to an inner side of the front barrel 2 such that a front end of the resilient member 4 is fixed to an internal hole of the front barrel 2. A displaceable refill body 5 contains a writing medium and is attached with a nib T of a ballpoint pen or the like and is arranged on inner sides of the exterior body 1 and the front barrel 2 such that the refill 5 is biased backward by the resilient member 4 and capable of moving back and forth. The nib T will described in detail later.

Figure 4:
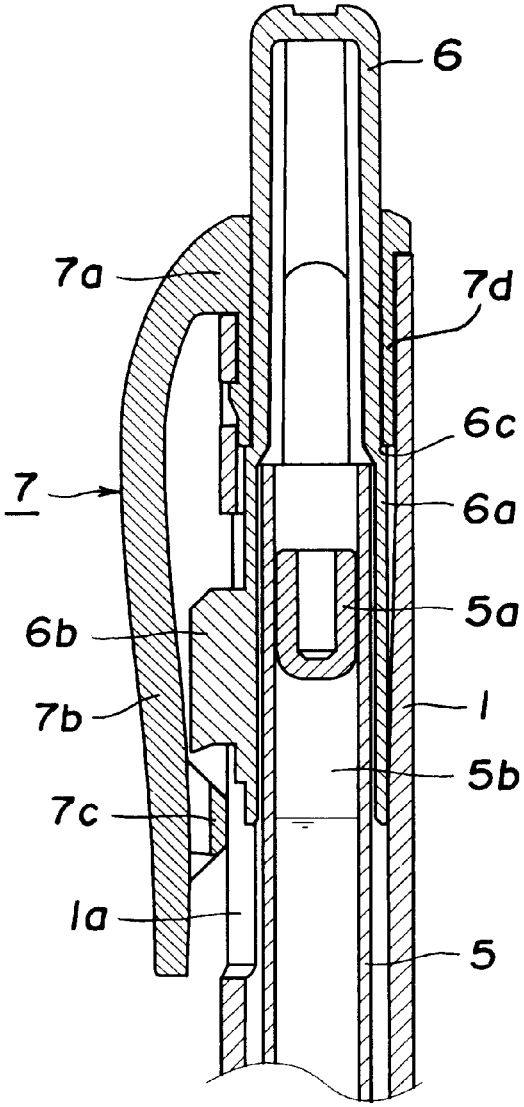
FIG. 4 is a vertical sectional view showing only a rear part of FIG. 1 on an enlarged basis.

In a vertical sectional view of FIG. 4 showing only a rear part of FIG. 1 on an enlarged basis, ink is sealed, by a float 5*a* and a highly viscous fluid 5*b*, in the refill 5 which is biased backward of the exterior body 1. An operating member 6 formed of polyoxymethylene resin is in abutment with a rear end of the refill 5. The operating member 6 includes a sliding sleeve portion 6*a* and an engagement portion 6*b*. A lateral hole la is formed in the exterior body 1. The engagement portion 6*b* is fitted to the lateral hole 1*a* such that the engagement portion 6*b* can slide back and forth. A clip 7 made of polycarbonate resin is fixed to a rear end opening portion of the exterior body 1 by press-fit or the like. This clip 7 includes an attachment basal portion 7*a* with respect to the exterior body 1 and a deformation plate portion 7*b* as an intermediate portion. An engagement element, i.e., a small piece 7*c*, with which the engagement portion 6*b* is to be engaged, is disposed at an inner surface of the deformation plate portion 7*b*. The clip 7 is resiliently biased towards the exterior body 1 and it also has a resilient force in a lateral direction which is perpendicular to a direction towards the exterior body 1.

The small piece 7*c* has a pair of opposite and generally parallel flat surfaces 7*c*1, 7*c*2 and a pair of opposite inclined surfaces 7*c*3, 7*c*4 at front and rear ends thereof, respectively. The surfaces 7*c*3, 7*c*4 are inclined relative to the surfaces 7*c*1, 7*c*2. The inclined front surface 7*c*3 facilitates engagement and disengagement of the clip 7 with the edge of a user's pocket.

A step portion 6*c* of the operating member 6 is in abutment with a front end of the sleeve portion 7*d* of the clip 7 to prohibit the operating member 6 from escaping backward.

Figure 5:
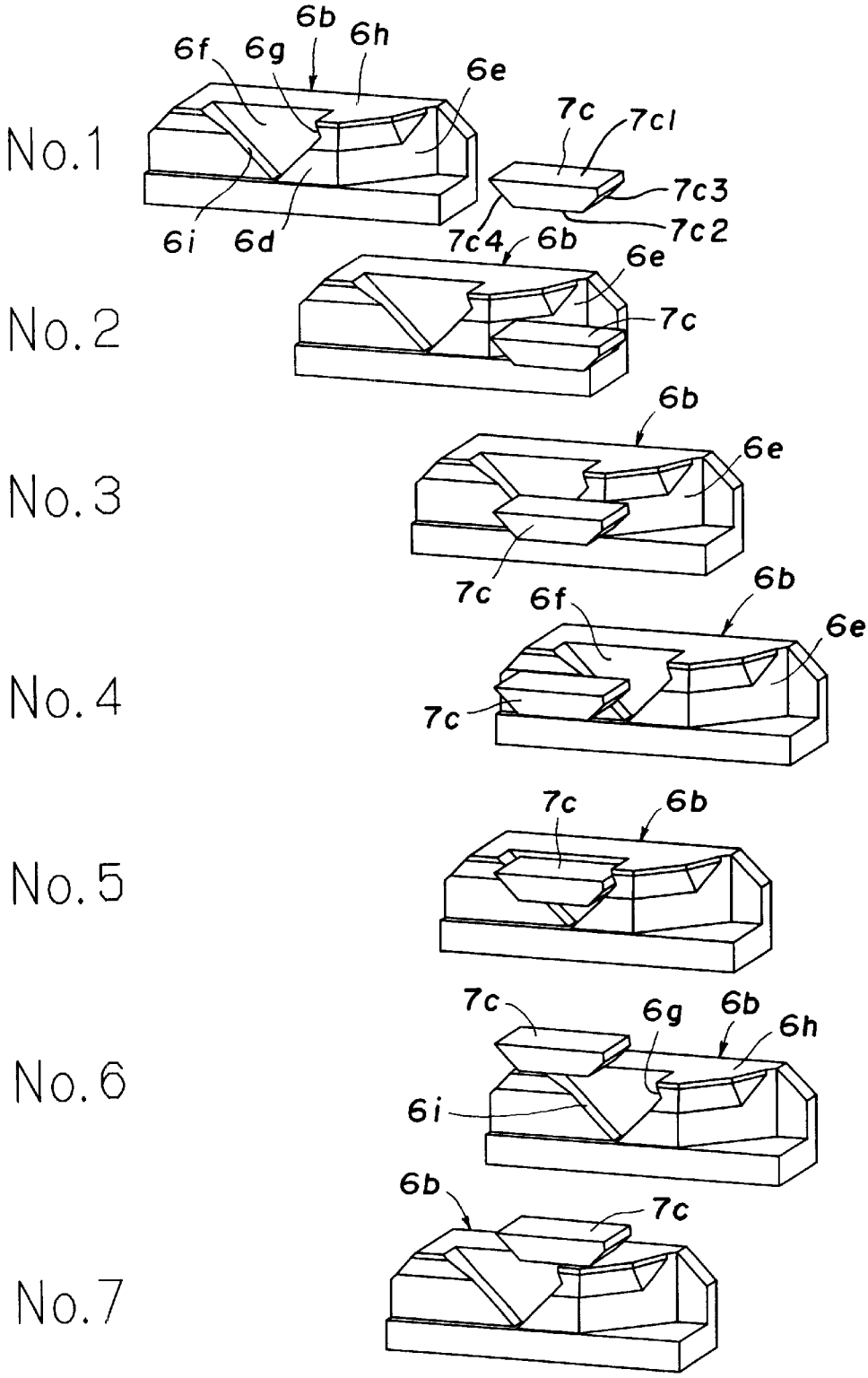
FIG. 5 is a partly perspective view showing a positional relation between an engagement portion and a small piece.
Figure 6:
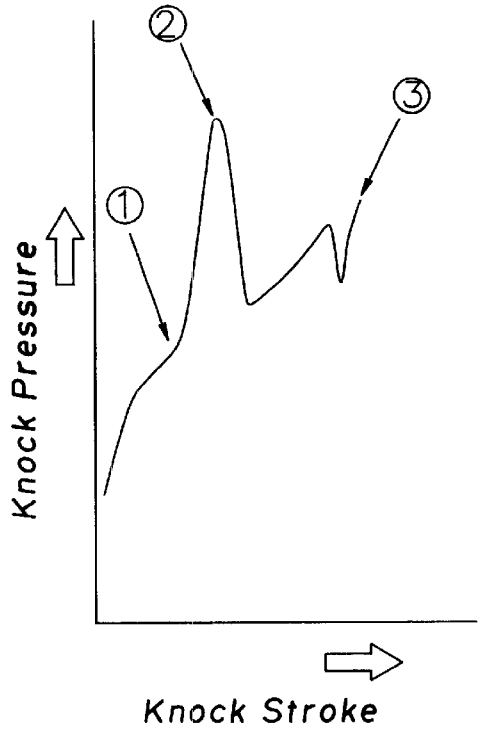
FIG. 6 is an explanatory view for explaining a function of a knocking operation of the retractable type writing instrument of the present invention.
Figure 7:
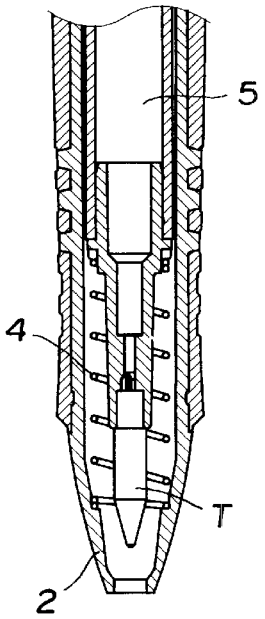
FIG. 7 is an explanatory view for explaining a function of the retractable type writing instrument according to the present invention.
Figure 8:
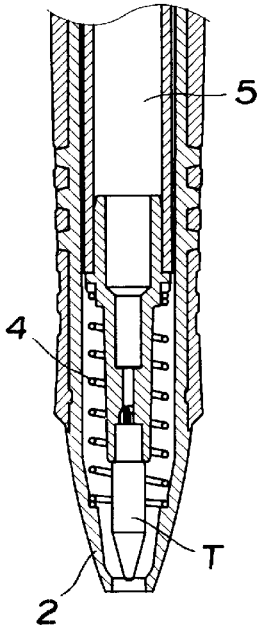
FIG. 8 is an explanatory view for explaining a function of the retractable type writing instrument according to the present invention.
Figure 9:
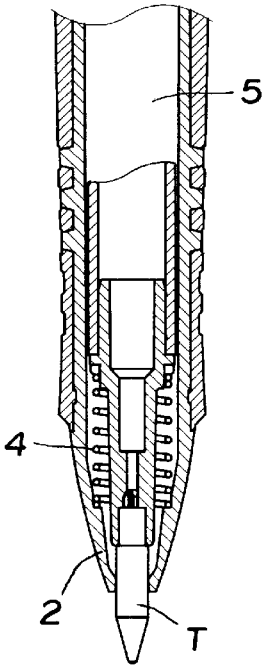
FIG. 9 is an explanatory view for explaining a function of the retractable type writing instrument according to the present invention.
Figure 10:
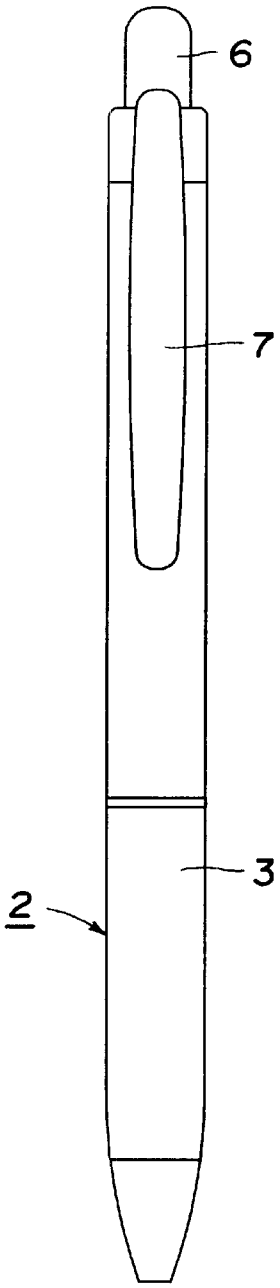
FIG. 10 is a front view showing an outer appearance of a retractable type writing instrument according to a second embodiment.
Figure 11:
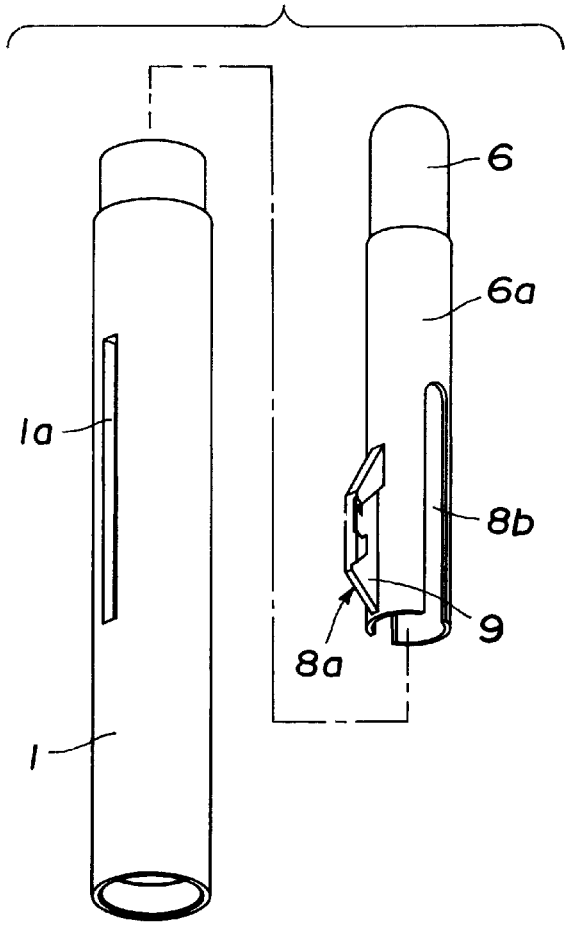
FIG. 11 is an exploded perspective view showing an exterior body and an operating member of the retractable type writing instrument according to the second embodiment.

In FIG. 5, there are shown the configurations of the engagement portion 6*b* and the small piece 7*c*, as well as a relation between the small piece 7*c* and the engagement portion 6*b*. There are shown various states of the nib from a first state in which the nib is in a received state to a last state in which the nib is brought back to the received state again via an intermediate state in which the nib is in a projected position, seven scenes of states in total each in the form of a perspective view when viewed from the back side of FIG. 4. Here, FIG. 5 is the only exception of the above-mentioned definition on the directions in the drawings. In FIG. 5, the leftside is referred to as "backward" and the rightside as "forward", respectively (the rightward in FIG. 5 indicates the nib side).

The engagement portion 6*b* of the several perspective views labeled first with No 1 (nib received state at an initial state) includes an engagement overriding portion 6*d* projecting laterally in such a manner so that the engagement portion 6*b* overrides the small piece 7*c* at the time of engagement of the nib T and overrides the slant surface 6*e* which is subjected to abutment with the small piece 7*c* first. The overriding slant surface 6*e* determines an angle of deviation when the engagement portion 6*b* overrides the small piece 7*c*. This angle of deviation is set to 45 degrees in this example. The engagement portion 6*b* includes a recess 6*f* at its one side surface and an engagement recess Gg at its front side which engagement recess 6*g* is abutted and engaged with a front end of the small piece 7*c*. The recess 6*f* has a second overriding slant surface 6*i* which is open at the upside in FIG. 5 and which reaches an upper surface portion 6*h* as it goes backward.

A positional relation and a state of engagement between the engagement portion 6*b* and the small piece 7*c* will now be described in detail. When the operating member 6 is pressed against the bias of the resilient member 4, the engagement portion 6*b* in the perspective view No. 1 moves forward. When the operating member 6 is further pressed, the overriding slant surface 6*e* of the engagement portion 6*b* is brought into abutment with a rear end of the small piece 7*c*. In that state, the overriding slant surface 6*e* and the small piece 7*c* are in line-connection or in point-connection (see the perspective view No. 2). When the operating member 6 is kept pressed, the small piece 7*c* is deviated laterally (towards the viewer's side in the illustration) by the overriding slant surface 6*e*. When the operating member 6 is still kept pressed, the engagement portion 6*b* moves along the side of the small piece 7*c* (see the perspective views Nos. 3 and 4). When the pressing of the operating member 6 is released, the engagement portion 6*b* moves backward. However, since the small piece 7*c* is restored, when viewed from the viewer, to the opposite side in the illustration by a lateral resiliency of the clip 7 and entered into the recess 6*f* so as to be abutted with the engagement recess 6*g*, the engagement between the engagement portion 6*b* and the small piece 7*c* is achieved (see the perspective view No. 5).

In order to release the engagement, the operating member 6 is pressed again. Then, the engagement portion 6*b* moves forward and the second overriding slant surface 6*i* pushes up the small piece 7*c*. As a result, the engagement between the engagement portion 6*b* and the small piece 7*c* is released. When the upper surface portion 6*i* of the engagement portion 6*b* comes to an undersurface, in the illustration, of the small piece 7*c*, the small piece 7*c* is caused to slide laterally on the upper surface portion 6*h* of the engagement portion 6*b* by the lateral resiliency of the clip 6 and returned to the back side in the illustration (see the perspective view No. 6).

When the pressing of the operating member 6 is released, the engagement portion 6*b* moves along the underside of the small piece 7*c* and returned to its initial state (see the perspective view No. 7).

In the present invention, if the writing instrument is put into a pocket or the like in the engaged state in which the refill 5 is left exposed from the tip of the front barrel 2, the small piece 7*c* of the clip 7 is raised from an outer peripheral surface of the exterior body 1. By this motion, the engagement between the engagement portion 6*b* and the small piece 7*c* is released and the initial state is restored. At the same time, the refill 5 is extracted into the front barrel 2.

A knock pressure (nib projecting load) in accordance with a knocking stroke of the operating member 6 will now be described with reference to FIGS. 6 to 9. When the operating member 6 is moved forward from the nib received state at the initial stage against the resilient force of the resilient member 4, the knock pressure of the operating member 6 is gradually increased (see FIG. 6 ① and FIG. 7). When the operating member 6 is kept moved, the knock pressure is abruptly raised to reach a maximum value by the overriding-contact of the small piece 7*c* with respect to the overriding slant surface 6*c* of the engagement portion 6*b*. At that time, the tip of the nib T of the refill 5 is not yet projected from the tip of the front barrel 2. That is to say, the overriding relation between the overriding slant surface 6*e* and the small piece 7*c* is achieved before the tip of the nib T is not yet projected from the tip of the front barrel 2 (see FIG. 6 ② and FIG. 8).

Subsequently, when the operating member 6 is kept pressed, the nib T is projected from beyond the tip of the front barrel 2. Since the overriding contact relation between the overriding slant surface 6*c* and the small piece 7*c* is finished, a moving resistance load becomes to have a value which corresponds to the resilient force of the resilient body 4 (see FIG. 6 ③ and FIG. 9). It should be noted that the moving resistance load of the operating member 6 at the time when the nib T is received, is a value within a range not exceeding a value of ③ in FIG. 6.

For the above-mentioned one example, test samples 1 to 10 were produced by varying the load which the engagement portion 6*b* and the small piece 7*c* receive at the time of a nib projecting operation, the angle of deviation at the time for the engagement portion 6*b* to override the small piece 7*c* and the spring constant of the coiled spring for biasing the refill backward. And the obtained samples were each tested as for ① a load at the time the nib is projected, ② a feel of operation at the time the nib is projected and ③ a state of handwriting. The results are shown in Table 1.

The load which the engagement portion 6*b* and the small piece 7*c* receive at the time the nib is projected was measured by measuring the load required for the engagement portion 6*b* and the small piece 7*c* to override using a platform scale and in a state in which the coiled spring for biasing the refill backward is removed.

① Load at the Time the Nib is Projected

A load amount for each sample at the time the nib is locked in its projected position was measured by pressing the platform scale with the operating member 6 of each sample.

② Feel of Operation at the Time the Nib is Projected

10 monitors made a nib projecting operation for each sample and then made an evaluation as for feel of operation in three ranks, A; too light-weighted to feel easy, B; feel easy because the operation is right and the nib is assuredly locked in its projected position, and C; too heavy-weighted and so operation tends to be stopped before the nib is locked in its projected position.

③ State of Handwriting and Presence or Absence of Leakage of Ink

A projecting and retracting operation was repeated 1,000 times for each sample and visually determined whether or not there is a leakage of ink from a rear end opening portion of an ink tank. Thereafter, a handwriting of 100 cm was carried out at a writing speed of 70 mm per second under the conditions of a writing load of 100 g and an angle of 70 degrees and then, it was visually determined whether or not there occurs blurring of the handwriting.

TABLE 1

| | receiving load (gf) | deviation angle (degree) | spring constant (kgf/mm) | projecting load① (gf) | feel of operation ② A | B | C | blur & leakage ③ |
|---|---|---|---|---|---|---|---|---|
| test sample 1 | 130 | 25 | 0.020 | 310 | 7 | 3 | 0 | no blur |
| test sample 2 | 250 | 45 | 0.020 | 470 | 3 | 7 | 0 | no blur |
| test sample 3 | 370 | 35 | 0.020 | 510 | 2 | 8 | 0 | no blur |
| test sample 4 | 370 | 45 | 0.020 | 710 | 0 | 10 | 0 | no blur |
| test sample 5 | 370 | 45 | 0.045 | 900 | 0 | 7 | 3 | no blur |
| test sample 6 | 370 | 55 | 0.020 | 880 | 0 | 7 | 3 | no blur |
| test sample 7 | 450 | 45 | 0.020 | 860 | 0 | 7 | 3 | no blur |
| test sample 8 | 560 | 65 | 0.020 | 1150 | 0 | 3 | 7 | no blur |
| test sample 9 | 560 | 65 | 0.050 | 1730 | 0 | 1 | 9 | yes blur |
| test sample 10 | 560 | 65 | 0.070 | 2370 | 0 | 0 | 10 | yes leak |

A second embodiment will now be described with reference to FIGS. 10 to 14. Like component parts of the preceding embodiment are denoted by like reference numerals and description thereof is omitted. A clip 7 is fixed to a rear end portion of an exterior body 1 by press-fit or the like. An operating member 6 is attached to a rear of the exterior body 1 such that the operating member 6 can move back and forth. A lateral hole la is formed in rear of the exterior body 1 and an engagement wall portion 8*a* is formed on an outer peripheral surface of a sliding barrel 8 of the operating member 6. The engagement wall portion 8*a* is fitted to the lateral hole la such that the engagement wall portion 8*a* can move back and forth but it is prohibited from rotation.

Reference numeral 8*b* denotes a split groove formed in front of the sliding barrel 8. The operating member 6 having the engagement wall portion 8*a* can be attached from the rear of the exterior body 1 by deformingly contracting the split groove 8*b* part.

Figure 12:
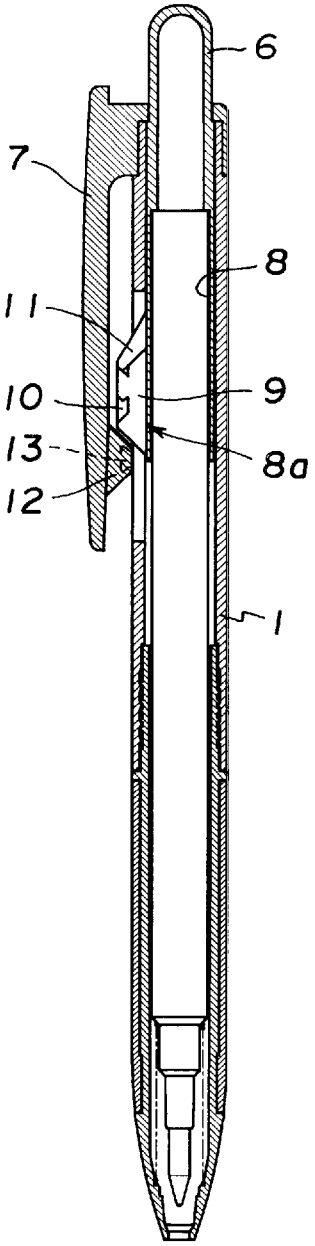
FIG. 12 is a vertical sectional view of the retractable type writing instrument according to the second embodiment.
Figure 13:
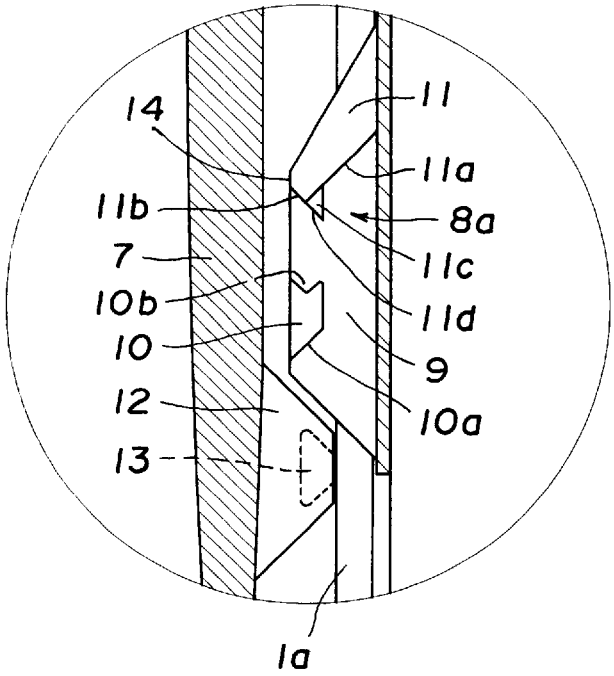
FIG. 13 is an enlarged view of an essential portion for explaining an operation of the second embodiment.

The engagement wall portion 8*a* will now be described with reference to FIGS. 12 and 13. The engagement wall portion 8*a* comprises a wall portion 9 vertically upstanding from the sliding barrel 8, a projecting lock portion formed on a side surface (viewer's side in the illustration) of the wall portion 9 and a guide portion 11. A front part of the lock portion 10 is defined as a slant surface 10*a* slanted leftward and downward. A V-shaped recess 10*b* is formed in a rear part of the lock portion 10. A slant surface 11*a* slanted rightward and upward and another slant surface 11*b* slanted rightward and downward are formed on a front part of the guide portion 11. Reference numeral 11*c* denotes a small slant surface of a triangular, planar configuration. A wall surface 11*d*, which is formed on a leftmost end, in the illustration, of the small slant surface 11*c* is connected to the slant surface 11*b* of the guide portion 11.

The clip 7 includes a projecting engagement protrusion 13 formed on the other side (opposite side when viewed from the viewer in the illustration) of the small piece 12. The clip 7 has resiliency and can resiliently be deformed leftward and rightward in the illustration. In a normal condition, however, it is arranged such that a right end, in the illustration, of the small piece 12 is located at the outer peripheral surface of the exterior body 1. In this embodiment, a front end portion of the clip 7 extends so far as to cover the lateral hole 1*a* formed in the exterior body 1.

Operation of the second embodiment will now be described. When the operating member 6 is pressed in the state of FIG. 12, the engagement wall portion 8*a* moves forward (downward in the illustration). When the operating member 6 is kept pressed, the slant surface 10*a* of the lock portion 10 is brought into abutment with the engagement protrusion 13. When the operating member 6 is still kept pressed, the small piece 12 of the clip 7 is displaced rightward in the illustration and the lock portion 10 is brought leftward, in the illustration, of the engagement protrusion 13. When the operating member 6 is kept pressed, the slant surface 11*a* of the guide portion 11 is brought into abutment with a rear end of the engagement protrusion 12 and therefore, the operating member 6 is caused to stop advancement. When the pressing of the operating member 6 is released, the clip 7 is moved back leftward, in the illustration, by the resilient restoring force. As the clip 7 is moved back, the recess 10*b* of the lock portion 10 is brought into abutment with the front end of the engagement protrusion 13 so that the lock portion 10 is locked. Since the refill 5 is fitted into the sliding barrel 8 of the operating member 6, the refill 5 is exposed from the tip of the front barrel 2 by the above-mentioned operation and locked in that state (see FIG. 14).

In order to release the locked state, the operating member 6 is pressed again. Then, the lock portion 10 is disengaged from the engagement protrusion 13. When the operating member 6 is kept pressed, the wall surface 11*d* formed on a final end of the small slant surface 11*c* is brought into abutment with the rear part of the engagement protrusion 13. When the operating member 6 is still kept pressed, the engagement protrusion 13 is displaced leftward, in the illustration, by the slant surface 11*b*. And an end face 14 of the engagement wall portion 8*a* is brought rightward, in the illustration, of the engagement protrusion 13. When the pressing of the operating member 6 is released, the engagement wall portion 8*a* moves rightward of the engagement protrusion 13 and returned to its initial state. As the engagement wall portion 8*a* is moved back, the refill 5 is also retracted into the front barrel 2.

According to this embodiment, since the resilient force, which acts in the direction enabling the clip 7 to move towards the exterior body 1, is chiefly utilized when the engagement protrusion and the engagement portion are engaged with each other or disengaged from each other by operation, durability of the attachment basal portion of the clip can be ensured.

A third embodiment will now be described with reference to FIGS. 14 and 15. Description of like parts of the above-mentioned embodiments is omitted for simplification only. In this embodiment, an engagement protrusion 15 is formed on an inner surface of the clip 7 such that the engagement protrusion 15 has a protruded and recessed shape. An engagement portion 16 is formed on a sliding barrel 8 of an operating member 6 such that the engagement portion 16 has a protruded shape. In this embodiment, the resilient force, which acts in a lateral direction which is a direction perpendicular to the direction for enabling the clip 7 to move towards the exterior body 1, is chiefly utilized for the operation.

Figure 14:
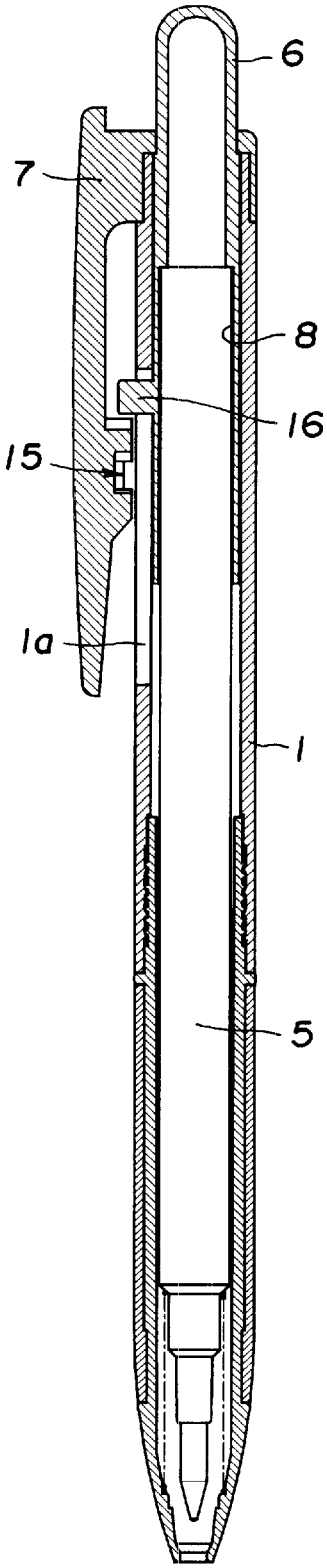
FIG. 14 is a vertical sectional view showing a third embodiment.
Figure 15:
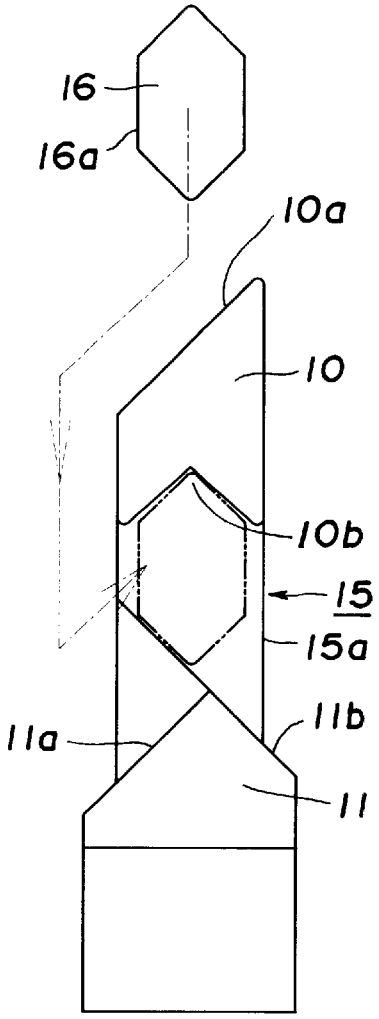
FIG. 15 is an explanatory view showing an operation of the third embodiment.

When the operating member 6 is pressed in the state of FIG. 14, the engagement portion 16 moves forward (downward in the illustration). When the operating member 6 is kept pressed, the engagement portion 16 is brought into abutment with a slant surface 10*a* of a lock portion 10. When the operating member 6 is still kept pressed, the clip 7 is displaced laterally as the engagement portion 16 moves forward and therefore, the engagement portion 16 is brought leftward, in the illustration, of the lock portion 10. When the operating member 6 is kept pressed, the engagement portion 16 is brought into abutment with a slant surface 11*a* of a guide portion 11 and therefore, the operating member 6 is caused to stop advancement. When the pressing of the operating member 6 is released, the clip 7 is moved back laterally by the resilient restoring force. Then, the engagement portion 16 moves towards (rightward and upward in the illustration) the lock portion 10 along the slant surface 11*a*, as the clip 7 is moved back. Subsequently, a rear end of the engagement portion 16 is brought into abutment with a recess 10*b* of the lock portion 10 so that the engagement portion 16 is locked to the lock portion 10.

In order to release the above locked state, the operating member 6 is pressed again. Then, the engagement portion 16 is disengaged from the recess 10*b*. When the operating member 6 is kept pressed, a front end of the engagement member 6 is brought into abutment with the slant surface 11*b* and the clip 7 is displaced laterally so that a left end 16*a* of the engagement portion 16 reaches an end face 15*a* of an engagement protrusion 15. When the pressing of the operating member 6 is released, the engagement portion 6 is moved along the right side of the lock portion 10 and returned to its initial state without being moved back to the recess 10*b*.

According to this embodiment, even if the writing instrument is put into the pocket or the like in the engaged state in which the refill 5 is left exposed from the tip of the front barrel 2, the engagement protrusion of the clip 7 and the engagement portion is more easily disengaged from each other and therefore, it is less likely that the user's clothes get stained by the nib.

A fourth embodiment will now be described with reference to FIGS. 16 and 17. Description of like parts of the above-mentioned embodiments is omitted. In this embodiment, an engagement protrusion 15 is formed on an inner surface of the clip 7 such that the engagement protrusion 15 has a protruded shape. An engagement portion 16 is formed on a sliding barrel 8 of an operating member 6 such that the engagement portion 16 has a protruded and recessed shape.

Figure 16:
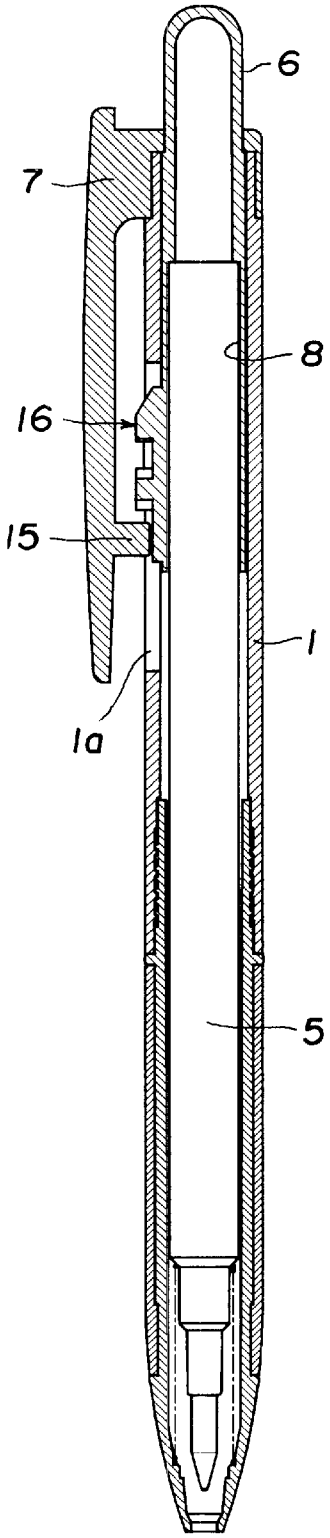
FIG. 16 is a vertical sectional view showing a fourth embodiment.
Figure 17:
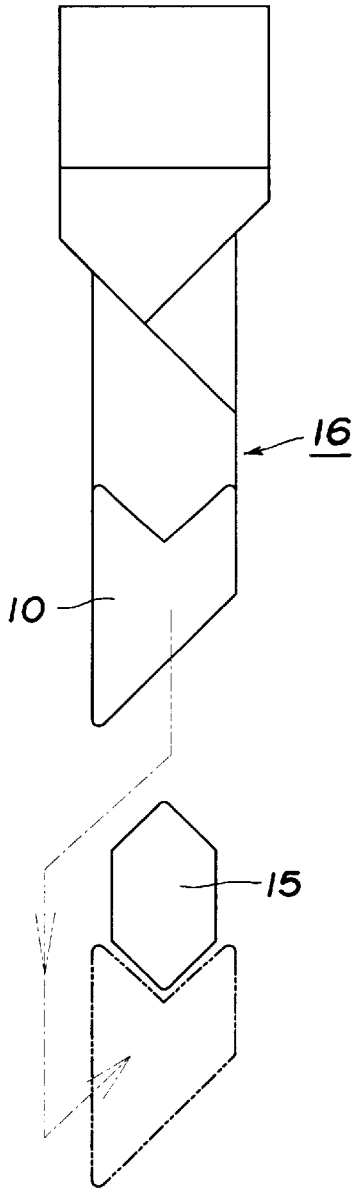
FIG. 17 is an explanatory view showing an operation of the fourth embodiment.

When the operating member 6 is pressed in the state of FIG. 16, the clip 7 is displaced laterally as the engagement portion 16 moves forward. When the pressing of the operating member 6 is released, the clip 7 is moved back laterally by the resilient restoring force. Then, a lock portion 10 is locked to an engagement protrusion 15, as the clip 7 is moved back laterally.

In order to release the above locked state, the operating member 6 is pressed again. Then, the engagement portion 16 is disengaged from the engagement protrusion 15 and returned to its initial state.

According to the fourth embodiment of the invention, the engagement protrusion 15 of the clip 7 can be formed smaller in configuration compared with the third embodiment.

Figure 18:
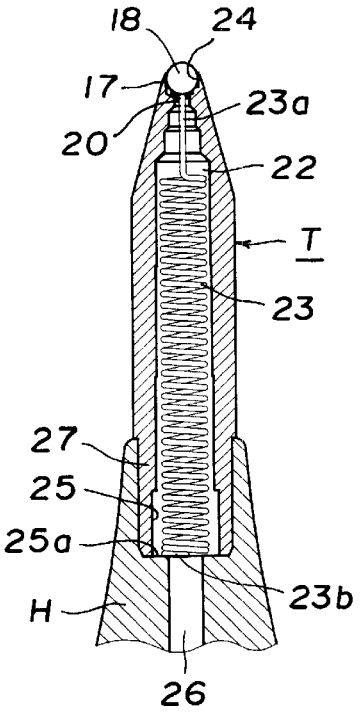
FIG. 18 is a vertical sectional view of a nib T.
Figure 20:
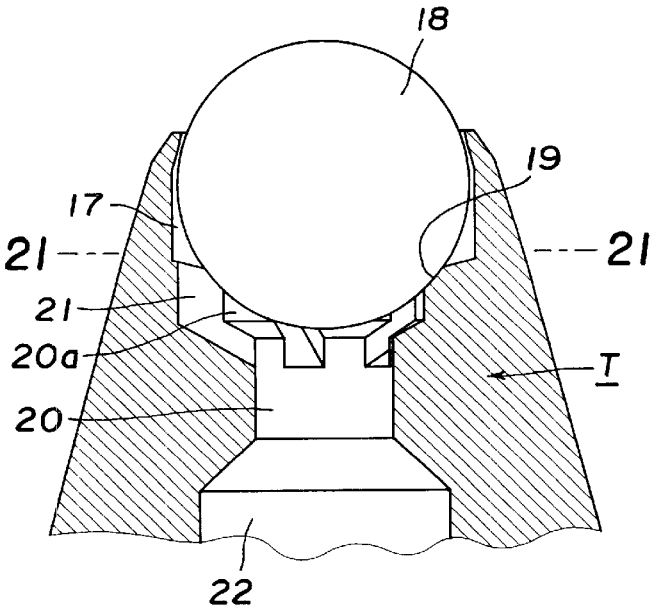
FIG. 20 is a vertical sectional view of an essential portion of the nib T of FIG. 19.
Figure 19:
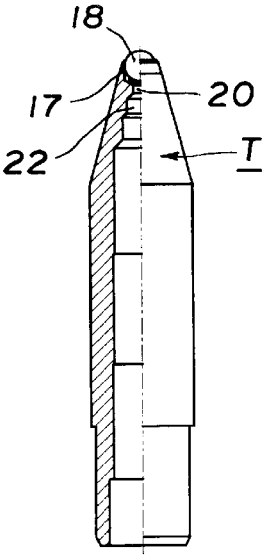
FIG. 19 is a vertical partial sectional view of a nib T.

The nib T used for the refill 5 of the above-mentioned various embodiments will now be described in detail. For the convenience of explanation, the nib is faced upward in the illustration. In FIG. 18, a spring for biasing a ball upward is incorporated in the nib T. In FIG. 19, there is no need of a provision of a spring for biasing the ball.

In FIGS. 18 to 21, a ball 18 is rotatably attached to a ball pinchingly holding portion 17 disposed at a tip of the nib T. A ball retaining seat 19 and a center hole 20 serving as an ink passageway are formed below, in the illustration, the ball 18. An upper part of the center hole 20 is defined as a radial wedge grooves 21 for feeding ink to the ball 18. A rear hole 22 is formed below the center hole 20. A counter bore portion 20*a* having a diameter larger than a diameter dimension of the center hole 20 but smaller than a diameter dimension of the ball retaining seat portion 19 is formed at an upper part of the center hole 20.

Figure 21:
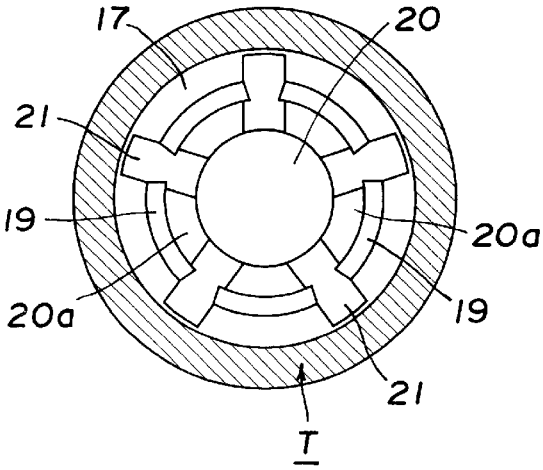
FIG. 21 is an enlarged cross-sectional view (the small piece is omitted from the illustration) taken along line 21—21 of FIG. 20.

The ball retaining seat portion 19 is formed by striking the ball 18 downward, in the illustration, so that the ball retaining seat portion 19 has the same R as the ball 18. As shown in FIG. 21, comparing with the conventional product, the ball retaining seat is formed narrower in width to the extent of a provision of the counter bore portion 20*a*. The diameter dimension of the ball retaining seat portion varies depending on lubricating property of ink and raw material of the tip. Preferably the diameter dimension of the ball retaining seat portion is about 75% to 90% of the ball diameter. For example, for a ball having a diameter dimension of 0.7 mm, the diameter dimension of the ball retaining seat portion may be set to 0.57 mm (81.4% of the ball diameter), the diameter dimension of the counter bore 20*a* may be set to a proper value and the width of the ball retaining seat portion 19 may be set to 0.01 mm to 0.1 mm.

A spring 23 is disposed at the rear hole 22 of the tip T shown in FIG. 18. One end of the spring 23 extends perpendicularly upward and is defined as a spring end portion 23*a* passing through the center hole 20. The ball 18 is carried by the spring end portion 23*a* and biased upward so as to be abutted with a distal end inner edge portion 24 of the ball pinchingly holding portion 17.

Reference character H denotes a nib holder. The nib holder H includes an inner hole 25 thereabove, an inner hole step portion 25*a* serving as a bottom of the inner hole 25 and a lead hole 26. A lower outer periphery of the nib T is a reduced diameter portion 27 which is assembled and fixed to the inner hole 25 of the nib T holder H by a press-fit or the like. A vertical length of this reduced diameter portion 27 is set slightly larger than the depth of the inner hole 25. The nib holder H fixedly supports the reduced diameter portion 27 of the nib T by its inner hole step portion 25*a* and also supports a rear end portion 23*b* of the spring 23.

When the ball 18 is brought into abutment with a writing surface, the ball 18 is pressed, the spring end portion 23*a* is moved backward by the pressing operation and the ink is fed to the writing surface via the tip inner edge portion 24 of the ball pinchingly holding portion 17 through the ball 18. When the ball 18 is brought away from the writing surface, the spring 23 is sprung back (or restored) to cause the ball 18 to contact the tip inner edge portion 24 intimately so that ejection of ink is blocked.

Function of the counter bore portion 20*a* in the nib T will now be described. When the diameter dimension of the hole portion 20*a* of the counter bore portion 20*a* is properly set beforehand and the ball 18 is knocked, a spring back of the knocking hardly occurs due to a provision of the counter bore portion 20*a*. As a result, the ball retaining seat portion 19 having the same R as the ball 18 and a small width, can be formed. When the writing instrument is to be used, that portion of the ball 18 which has an is enlarged diameter sits on the ball retaining seat portion 19 having a small width and rotates the ball 18. Accordingly, lateral play is reduced and centering of the ball 18 is retained. As a result, there can be obtained such writing characteristics that a smooth rotation is ensured and ink blobbing hardly occurs.

Although, in the nib T of FIG. 18, the diameter dimension of the center hole 20 is set to a required least possible diameter in order to maintain the centering property in the center hole 20 of the spring end portion 23*a* on which the ball 18 is carried, a required quantity of ink can be delivered to the ball pinchingly holding portion 17 owing to a provision of the counter bore portion 20*a* nevertheless the center hole 20 has a small diameter.

As described hereinbefore, according to the present invention, there is provided a retractable type writing instrument wherein an operating member movable relative to an exterior body through operation is interlocked with a refill body having a nib at its tip, an engagement portion for engaging an engagement protrusion formed on an inner surface of a clip attached to the exterior body is formed on the operating member, the engagement protrusion is engaged with the engagement portion, thereby locking the nib of the refill body in a state of the nib projected from a tip of the exterior body, and the locking of the nib in its projected position is released by an operation to be made in the same direction as the operation for locking the nib in its projected position, the retractable writing instrument being characterized in that when the engagement protrusion and the engagement portion are to be engaged with or disengaged from each other by the operation, a relative movement between the engagement protrusion and the engagement portion at the time of engagement or disengagement consists of a combination of a movement in a same plane direction and a movement towards or away from the plane, or a retractable type writing instrument wherein a clip including an attachment basal portion with respect to an exterior body having a nib projection hole at a tip thereof, a deformation plate portion as an intermediate part and an engagement protrusion at an inner surface of the deformation plate portion is arranged outside the exterior body, a refill body having a nib at a tip thereof and storing therein ink is received in the exterior body such that the refill body can move back and forth in a state in which the refill body is biased backward by a coiled spring, an operating member is moved to cause the refill body or a connecting member with respect to the refill body to move so that the nib projects from the nib projection hole, the refill body or the member to be connected to the refill body is brought into engagement with the engagement protrusion of the clip, thereby maintaining the projected state of the nib from the exterior body, the operating member is moved again to release the engagement so that the nib is received in the exterior body by a backward biasing force of the coiled spring, the retractable type writing instrument being characterized in that the engagement protrusion of the clip is formed of polycarbonate resin, an engagement portion of the refill body or the member to be connected to the refill body with respect to the engagement protrusion is formed of polyoxymethylene resin, and a surface of the engagement portion and a protruded portion of the engagement protrusion are contacted with each other at the time of an overriding engagement for projecting the nib. Accordingly, the mechanism for locking/releasing the projection and retraction is simple, the number of component parts is reduced, assembling is easy and the cost is low. Moreover, the barrel length can be reduced to the extent of the feature in that the mechanism for locking/releasing the projection and retraction is not incorporated in the internal rear part of the barrel. Furthermore, sureness of the locking of the projection/retraction through operation and actual feel of the operation can be obtained. In addition, no leakage of ink and no blurring of the handwriting occurs even if the projecting and retracting operation of the nib is repeated. Moreover, there is no such a fear that the user's clothes get stained by accidental pressing of the knock member after use.

What is claimed is:

1. A retractable-type writing instrument comprising:

a tubular body having a longitudinal axis, a front end, a rear end, and a tip disposed at the front end;

a displaceable body disposed in the tubular body for undergoing movement in an axial direction along the longitudinal axis and containing therein a writing medium during use of the writing instrument;

a clip having a first end portion connected to the tubular body and a second end portion;

an engagement member having a first surface connected to the second end portion of the clip, a second surface confronting the tubular body, and a pair of third surfaces extending from opposite sides of the second surface toward the first surface, each of the third surfaces being inclined at a given angle relative to the longitudinal axis of the tubular body;

an operating member mounted in the tubular body for undergoing movement in the axial direction to move the writing medium between a withdrawal position at which the writing medium is withdrawn into the tubular body and a projected position at which a tip of the writing medium projects from the tip of the tubular body; and an engagement body connected to the operating member for movement therewith and for engaging the engagement member during movement of the operating member in the axial direction to lock the writing medium in the projected position.

2. A retractable-type writing instrument according to claim 1; wherein the engagement body engages the engagement member during an initial axial movement of the operating member in a direction toward the front end of the tubular body; and wherein the engagement body is disengaged from the engagement member during a subsequent axial movement of the operating member in the direction toward the front end of the tubular body to thereby move the displaceable body to the withdrawal position.

3. A retractable-type writing instrument according to claim 2; wherein the clip is connected to the tubular body so that at least the front end portion of the clip undergoes movement in directions toward and away from the longitudinal axis of the tubular body when the engagement body is engaged with and disengaged from the engagement member.

4. A retractable-type writing instrument according to claim 3; further comprising a biasing member for urging the displaceable body toward the rear end of the tubular body.

5. A retractable-type writing instrument according to claim 1; wherein the third surfaces of the engagement member are inclined so that their heights gradually increase towards the first surface of the engagement member.

6. A retractable-type writing instrument according to claim 1; wherein the third Surfaces of the engagement member converge towards the second surface thereof.

7. A retractable-type writing instrument according to claim 1; wherein the tubular body is formed of polymethyl methacrylic resin.

8. A retractable-type writing instrument comprising:

a tubular body having a longitudinal axis, a front end, a rear end, and a tip disposed at the front end;

a refill body for storing ink and for undergoing movement in an axial direction along the longitudinal axis, the refill body having a writing tip extending from a front end thereof;

a biasing member for urging the refill body toward the rear end of the tubular body;

a clip having a first end portion connected to the tubular body, a second end portion, and an intermediate portion;

an engagement member having a first surface connected to the intermediate portion of the clip, a second surface confronting the tubular body, and a pair of third surfaces extending from opposite sides of the second surface toward the first surface, each of the third surfaces being inclined at a given angle relative to the longitudinal axis of the tubular body;

an operating member mounted in the tubular body for undergoing movement in the axial direction to move the refill body between a withdrawal position at which the writing tip is withdrawn into the tubular body and a projected position at which the writing tip projects from the tip of the tubular body; and an engagement body connected to the refill body for movement therewith and for engaging the engagement member during movement of the operating member in the axial direction to lock the writing medium in the projected position.

9. A retractable-type writing instrument according to claim 8; wherein the tubular body is formed of polymethyl methacrylic resin.

10. A retractable-type writing instrument according to claim 8; wherein the engagement member is formed of polycarbonate resin.

11. A retractable-type writing instrument according to claim 10; wherein the engagement body is formed of polyoxymethylene resin.

12. A retractable-type writing instrument according to claim 8; wherein the third surfaces of the engagement member are inclined so that their heights gradually increase towards the first surface of the engagement member.

13. A retractable-type writing instrument according to claim 8; wherein the third surfaces of the engagement member converge towards the second surface thereof.

14. A retractable-type writing instrument according to claim 8; wherein the engagement body has a surface inclined relative to the longitudinal axis at an angle in the range of 35 degrees to 55 degrees for engaging the engagement member.

15. A retractable-type writing instrument according to claim 14; wherein a maximum load produced during engagement between the engagement member and the inclined surface of the engagement body is in the range of 250 gf to 450 gf.

16. A retractable-type writing instrument according to claim 8; wherein the biasing member has a spring constant in the range of 0.015 kgf/mm to 0.045 kgf/mm.

17. A retractable-type writing instrument according to claim 8; wherein the refill body has a ball and a casing having a holding portion rotatably supporting the ball and an ink passageway communicating with the holding portion for feeding ink to the ball.

18. A retractable-type writing instrument according to claim 17; wherein the holding portion of the casing has a ball retaining seat on which the ball rests, a counter bore portion disposed between the ball retaining seat and the ink passageway and having a diameter smaller than that of the ball retaining seat, and a plurality of generally wedge-shaped grooves formed in an upper portion of the ink passageway.

19. A retractable-type writing instrument according to claim 1; wherein the engagement body has a surface inclined relative to the longitudinal axis at an angle in the range of 35 degrees to 55 degrees for engaging the engagement member.

20. A retractable-type writing instrument according to claim 19; wherein a maximum load produced during engagement between the engagement member and the inclined surface of the engagement body is in the range of 250 gf to 450 gf.

21. A retractable-type writing instrument according to claim 1; further comprising a biasing member for urging the displaceable body toward the rear end of the tubular body; wherein the biasing member has a spring constant in the range of 0.015 kgf/mm to 0.045 kgf/mm.

22. A retractable-type writing instrument according to claim 1; wherein the displaceable body comprises a refill body having a ball and a casing having a holding portion rotatably supporting the ball and an ink passageway communicating with the holding portion for feeding ink to the ball.

23. A retractable-type writing instrument according to claim 22; wherein the holding portion of the casing has a ball retaining seat on which the ball rests, a counter bore portion disposed between the ball retaining seat and the ink passageway and having a diameter smaller than that of the ball retaining seat, and a plurality of generally wedge-shaped grooves formed in an upper portion of the ink passageway.

* * * * *